US007268652B2

(12) United States Patent
Marks et al.

(10) Patent No.: US 7,268,652 B2
(45) Date of Patent: Sep. 11, 2007

(54) CRADLE ASSEMBLY WITH OPENING ASSIST MECHANISM AND ELECTRICAL SWITCHING APPARATUS EMPLOYING THE SAME

(75) Inventors: Douglas C. Marks, Murrysville, PA (US); Robert M. Slepian, Murrysville, PA (US); David C. Turner, Imperial, PA (US)

(73) Assignee: Eaton Corporation

( * ) Notice: Subject to any disclaimer, the term of this patent is extended or adjusted under 35 U.S.C. 154(b) by 140 days.

(21) Appl. No.: 11/176,536

(22) Filed: Jul. 7, 2005

(65) Prior Publication Data

US 2007/0008054 A1 Jan. 11, 2007

(51) Int. Cl.
*H01H 3/46* (2006.01)
*H01H 75/00* (2006.01)

(52) U.S. Cl. ..... 335/6; 335/9; 335/21; 335/167; 335/171; 335/189; 335/191; 200/401

(58) Field of Classification Search ..... 335/6, 335/8, 9, 10, 14, 15, 21, 22, 167–171, 185, 335/189, 191; 200/400, 401
See application file for complete search history.

(56) References Cited

U.S. PATENT DOCUMENTS 4,144,427 A 3/1979 Gryctko et al.
4,151,495 A 4/1979 Rys et al.
4,276,457 A 6/1981 Myers
4,650,944 A 3/1987 Tedesco et al.
5,258,733 A 11/1993 Link et al.
5,319,169 A 6/1994 Link et al.
5,909,161 A 6/1999 DiMarco et al.
5,994,988 A 11/1999 Ferree et al.
6,015,959 A 1/2000 Slepian et al.
6,541,727 B2 4/2003 Beck et al.
6,727,788 B1 4/2004 Lawson et al.

*Primary Examiner*—Ramon M. Barrera
(74) *Attorney, Agent, or Firm*—Martin J. Moran

(57) ABSTRACT

An opening assist mechanism is for the cradle assembly of a circuit breaker including a housing enclosing separable contacts, and an operating mechanism for opening and closing the separable contacts. The operating mechanism includes a trip bar and a cradle assembly. The cradle assembly includes a first toggle link, a second toggle link pivotally coupled to the first toggle link by a first pivot, and a cradle member pivotally coupled to the second toggle link by a second pivot. The cradle member includes a third pivot and a latching portion structured to engage the trip bar when the cradle assembly is disposed in a position corresponding to the separable contacts being closed or otherwise closeable. The opening assist mechanism comprises an actuator, such as a kicker pin, disposed on the cradle member and structured to engage and move at least one of the first and second toggle links in response to an actuation of the operating mechanism. In this manner, the opening assist mechanism resists the tendency of the first and second toggle links to jam in an over-center configuration.

1 Claim, 4 Drawing Sheets

CRADLE ASSEMBLY WITH OPENING ASSIST MECHANISM AND ELECTRICAL SWITCHING APPARATUS EMPLOYING THE SAME

BACKGROUND OF THE INVENTION

1. Field of the Invention

The present invention relates generally to electrical switching apparatus and, more particularly, to an opening assist mechanism for the cradle assembly of a circuit breaker. The invention also relates to circuit breakers having cradle assemblies with opening assist mechanisms.

2. Background Information

Switches used in electrical power distribution systems are generally old and well known in the art. Such switches include molded case circuit breakers for protecting electrical circuitry from damage due to a trip condition (e.g., without limitation, an overcurrent condition; an overload condition; an undervoltage condition; a relatively high level short circuit or fault condition; a ground fault or arc fault condition).

Molded case circuit breakers generally include an operating mechanism having at least one pair of separable contacts which are operated either manually, by way of handle disposed on the exterior of the circuit breaker housing, or automatically by way of a trip mechanism in response to the trip condition. Some trip mechanisms typically comprise an energy storage mechanism such as, for example, a spring, and a trip bar which is adapted to actuate a cradle assembly. The cradle assembly is structured to open the separable contacts in response to the trip condition. The spring or other suitable energy storage mechanism is charged by closing the switch. This operation can be performed manually, for example, by a handle and ratchet assembly, or it may be accomplished by using, for example, a motor operator. An example of the energy storage mechanism and handle and ratchet charging mechanism therefor is shown and described, for example, in U.S. Pat. No. 6,015,959, which is incorporated herein by reference.

The separable contacts of molded case circuit breakers generally include a stationary or fixed contact and a moveable contact secured to the free end of a pivotally mounted contact arm. In response to the trip condition, the cradle assembly opens (e.g., separates) the moveable contact from the stationary contact. More specifically, the cradle assembly includes a pair of toggle links and a cradle member structured to latch and unlatch the toggle links. When unlatched, for example, in response to the trip condition, the toggle links pivot the contact arm in order to open the separable contacts. The toggle links are pivotally coupled (e.g., pinned) with respect to one another and to the cradle member, and generally comprise an over-center toggle mechanism wherein one of the toggle links is adapted to engage a latching surface on the cradle member in order to latch the cradle assembly when the circuit breaker is not tripped. Accordingly, when that toggle link is disengaged from the latching surface on the cradle member, the operating assembly causes the separable contacts to be opened. The circuit breaker trip bar also engages the toggle link and, in a normal position, the trip bar allows the toggle link to latch the cradle assembly. However, when the trip bar is rotated, the toggle link becomes disengaged from the latching surface on the cradle member to allow the operating mechanism to trip or open the separable contacts. A more detailed description of the operation of the operating assembly can be found, for example, in U.S. Pat. No. 6,541,727, which is incorporated herein by reference. Such operating assembly or a comparable version thereof is commonly employed in a wide variety of electrical switching apparatus other than, and in addition to, the molded case circuit breaker described hereinbefore.

Although the foregoing operating assembly and, in particular, the cradle assembly thereof, is a relatively tried and true design, it suffers from a number of unique disadvantages under certain circumstances. Specifically, the toggle links of the over-center toggle mechanism might lock or become jammed or wedged in the over-center configuration. The over-center configuration occurs when the separable contacts are closed (e.g. when the circuit breaker is ON). Jamming of the toggle links in the over-center configuration can result in the cradle assembly, and thus the operating mechanism, becoming "stuck" in the ON position. This may disadvantageously prohibit the circuit breaker from tripping and could, therefore, result in severe damage occurring to electrical equipment in communication with the breaker. It could also result in the general inability to turn the circuit breaker OFF. In order to alleviate these potentially dangerous circumstances, there is a need for a mechanism which is adapted to dislodge or initiate movement of the toggle links of the cradle assembly from the over-center position.

There is, therefore, room for improvement in opening assist mechanisms for cradle assemblies and in circuit breakers employing the same.

SUMMARY OF THE INVENTION

These needs and others are satisfied by the present invention, which is directed to an opening assist mechanism for the cradle assembly of a circuit breaker. The opening assist mechanism initiates movement of and/or dislodges the toggle links of the cradle assembly from the over-center configuration corresponding to the circuit breaker being in the ON position, in order that the circuit breaker may trip in response to a trip condition or that it may be manually turned OFF.

As one aspect of the invention, an opening assist mechanism is provided for a cradle assembly of an electrical switching apparatus. The cradle assembly includes a cradle member, a first toggle link, and a second toggle link. The first and second toggle links are pivotally joined by a first pivot, and the second toggle link is pivotally coupled to the cradle member by a second pivot. The cradle member includes a third pivot, and is moveable among first and second positions. When the cradle assembly is disposed in the second position, the first and second toggle links are disposed in an over-center configuration and the first pivot is disposed generally adjacent the third pivot. The opening assist mechanism comprises: an actuator structured to initiate and facilitate movement of the first and second toggle links from the over-center configuration, in order to resist the first and second toggle links becoming jammed in the over-center configuration.

The actuator may comprise a toggle link engagement structured to be disposed on the cradle member, and to engage and move at least one of the first and second toggle links away from the over-center configuration. The toggle link engagement may comprise a protrusion structured to protrude from the cradle member proximate the third pivot of the cradle member. The toggle link engagement may be a kicker pin structured to engage and deflect the first toggle link which thereby pivots about the first pivot in order to move the second toggle link pivotally coupled thereto.

As another aspect of the invention, a cradle assembly is for an electrical switching apparatus including a housing, separable contacts enclosed by the housing, and an operating mechanism structured to open and close the separable contacts. The operating mechanism includes the cradle assembly which is structured to trip open the separable contacts in response to a trip condition. The cradle assembly comprises: a first toggle link; a second toggle link pivotally coupled to the first toggle link by a first pivot; a cradle member pivotally coupled to the second toggle link by a second pivot, the cradle member including a third pivot; and a cradle opening assist mechanism comprising an actuator disposed on the cradle member and structured to initiate and facilitate movement of the first and second toggle links from an over-center configuration in which the first and second toggle links have a tendency to become jammed, the cradle opening assist mechanism being structured to resist the jamming of the toggle links.

The cradle assembly may be moveable among a first position and a second position. When the cradle assembly is disposed in the first position, the first, second, and third pivots may be disposed in an orientation generally representative of an isosceles triangle, and when the cradle assembly is disposed in the second position and the first and second toggle links are disposed in the over-center configuration, the first, second, and third pivots may be disposed in an orientation generally representative of an acute triangle.

As another aspect of the invention, an electrical switching apparatus comprises: a housing; separable contacts enclosed within the housing; and an operating mechanism for opening and closing the separable contacts, the operating mechanism including a trip bar and a cradle assembly, the cradle assembly being moveable between a first position corresponding to the separable contacts being open, and a second position corresponding to the separable contacts being closeable, the cradle assembly comprising: a first toggle link, a second toggle link pivotally coupled to the first toggle link by a first pivot, a cradle member pivotally coupled to the second toggle link by a second pivot, the cradle member including a third pivot and a latching portion structured to engage the trip bar when the cradle assembly is disposed in the second position, and an opening assist mechanism comprising an actuator disposed on the cradle member and structured to engage and move at least one of the first and second toggle links in response to an actuation of the operating mechanism, wherein the first and second toggle links have a tendency to jam in an over-center configuration, and wherein the opening assist mechanism resists the tendency.

The operating mechanism may include a spring which is structured to bias at least one of the trip bar and the cradle assembly, thereby providing the actuation of the operating mechanism. The operating mechanism may also be operable among an ON position in which the separable contacts are closed, and OFF and tripped positions wherein the separable contacts are open. The first and second toggle links may be disposed in the over-center position when the electrical switching apparatus is ON. When the operating mechanism of the electrical switching apparatus is moved from the ON position, the actuator may engage the at least one of the first and second toggle links in order to remove the links from the over-center configuration. The trip bar of the electrical switching apparatus operating mechanism may be structured to pivot in response to the trip condition, thereby releasing the latching portion of the cradle member and, when the latching portion of the cradle member is released, the cradle assembly may be unlatched and the actuator of the cradle member may engage the first toggle link.

The separable contacts may comprise a stationary contact and a moveable contact having a contact arm and a stop therefor, and the cradle opening assist mechanism may include a bias element coupled to the stop wherein the bias element is structured to bias and initiate movement of the cradle member of the cradle assembly in order that the actuator moves the at least one of the first and second toggle links, thereby further resisting the jamming of the toggle links in the over-center configuration.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
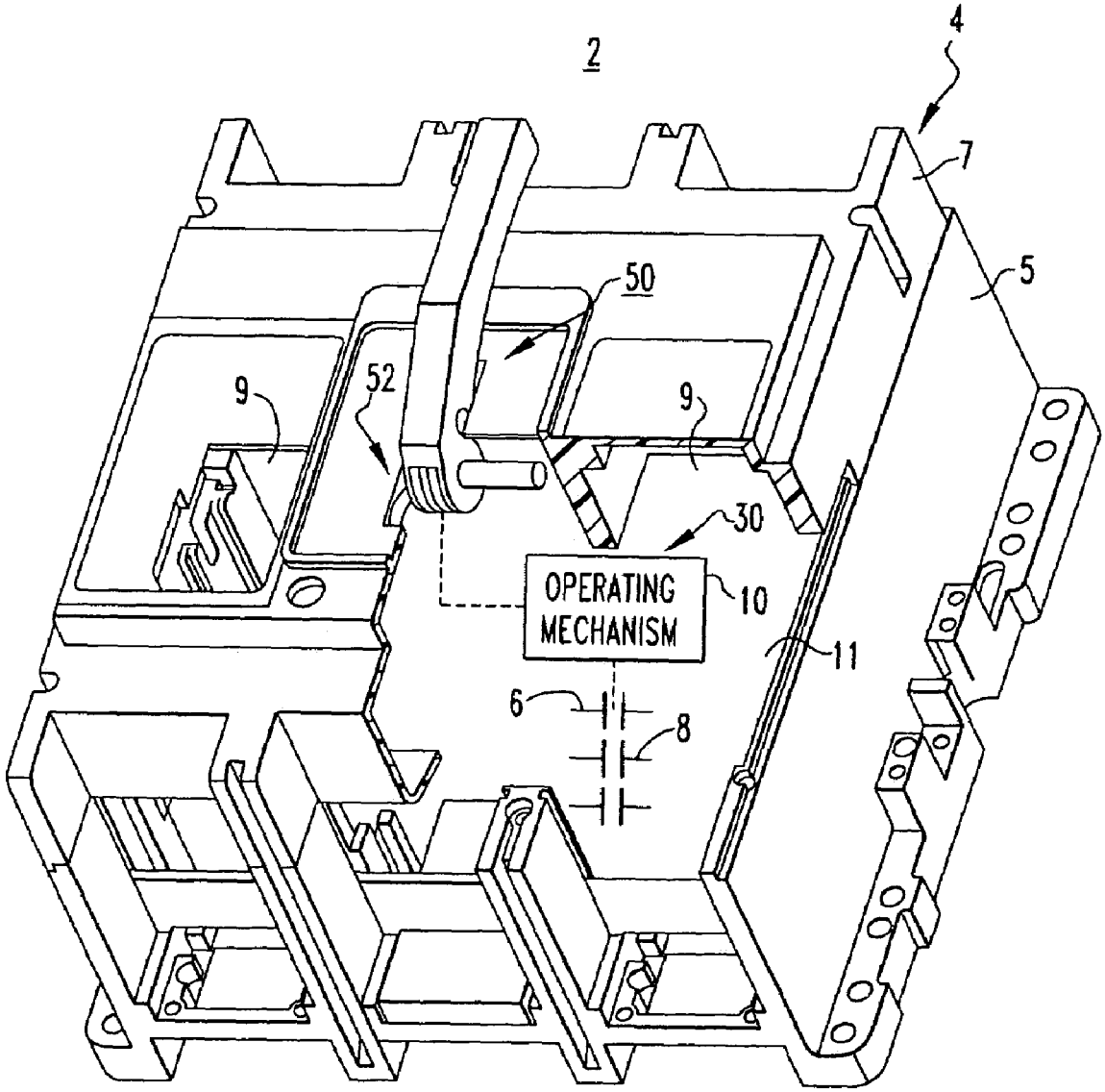
FIG. 1 is an isometric view of a three-pole molded case circuit breaker comprising a power switch having a handle and ratchet energizing assembly, with a portion of the circuit breaker housing cut away to show internal structures.

For purposes of illustration, the invention will be described as applied to a molded case circuit breaker, although it will become apparent that it could also be applied to other electrical switching apparatus (e.g., without limitation, circuit switching devices and other circuit interrupters such as contactors, motor starters, motor controllers and other load controllers) for power distribution systems.

Directional phrases used herein, such as, for example left, right, clockwise, counter clockwise, and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "trip condition" refers to any abnormal electrical condition causing a circuit breaker to trip and expressly includes, without limitation, an overcurrent condition, an overload condition, or a relatively high level short or fault condition, or a ground fault or arc fault condition.

Figure 3A:
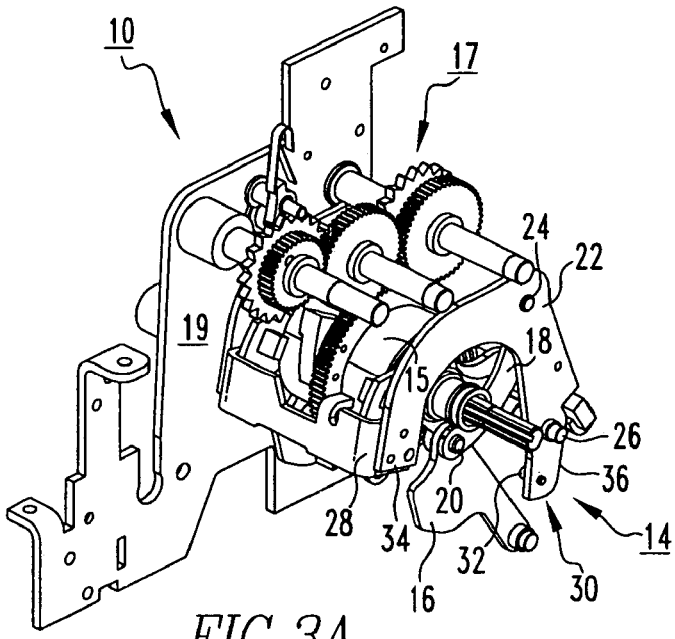
FIG. 3A is an isometric view of the cradle assembly for the operating mechanism of FIG. 2.
Figure 4A:
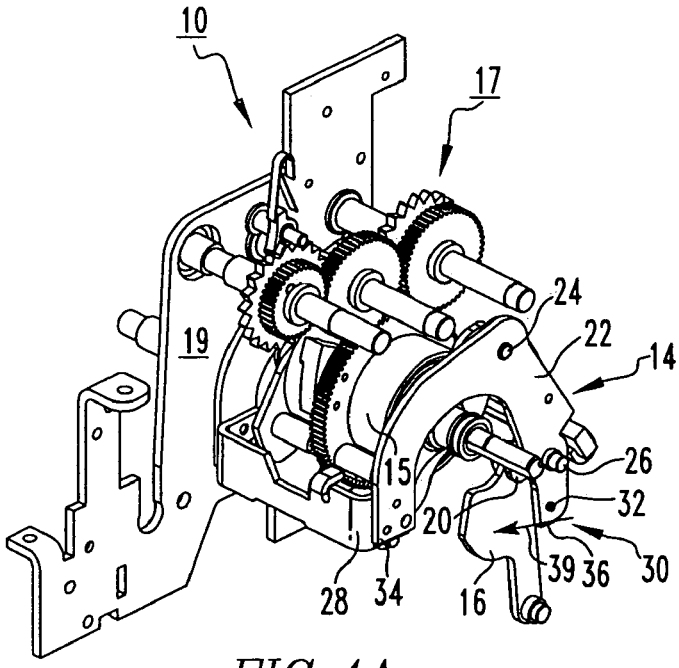
FIG. 4A is an isometric view of the cradle assembly of FIG. 3A modified to show the over-center configuration of the cradle assembly toggle links when the circuit breaker is ON and the separable contacts are closed.
Figure 5:
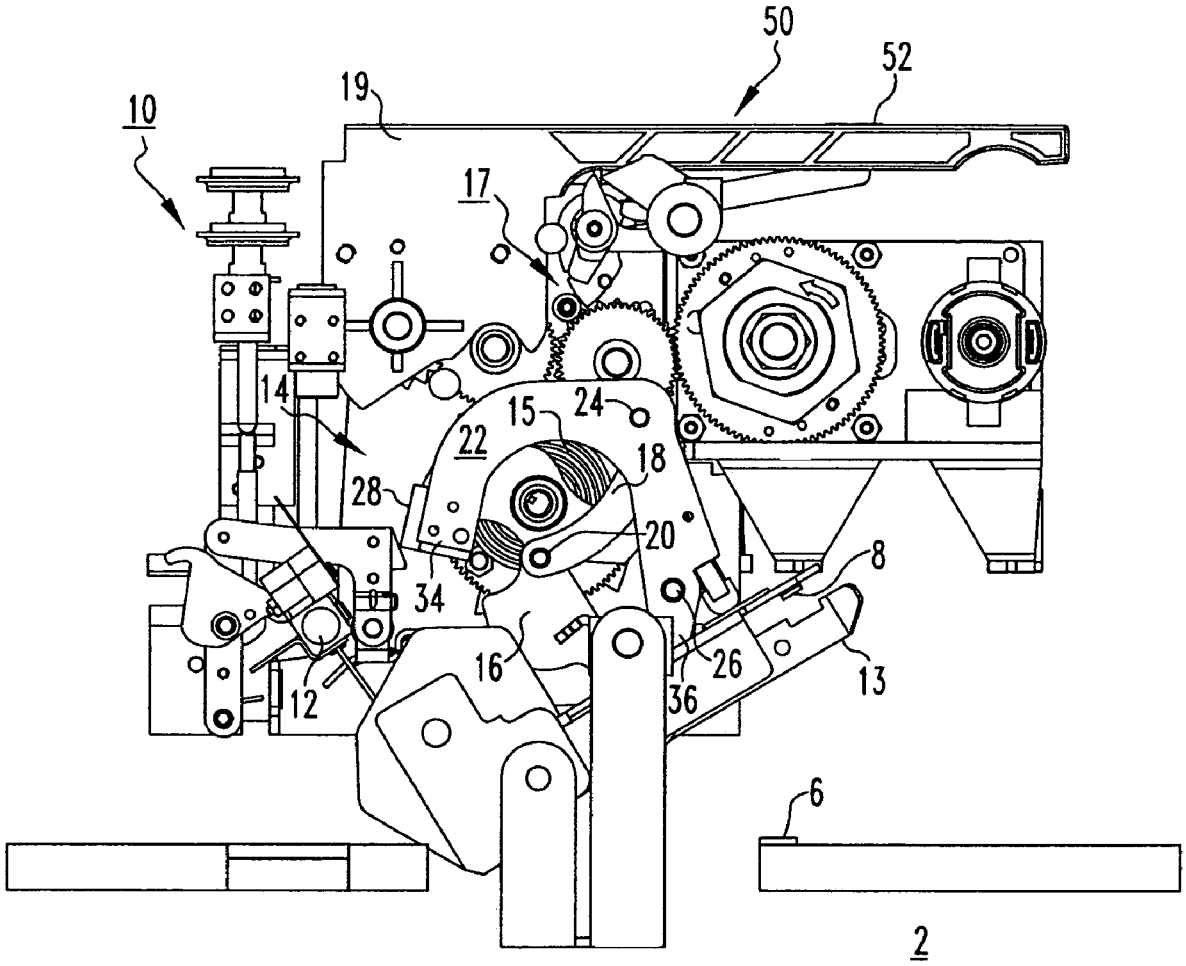
FIG. 5 is a side elevational view of the opposite side of the operating assembly of FIG. 2, modified to show the cradle assembly and the separable contacts in their tripped configurations.

FIG. 1 shows a power switch which is a molded case circuit breaker 2. The molded case circuit breaker 2 includes a molded housing 4 made of an electrically insulative material, such as plastic, and has a base 5 and a cover 7. The base 5 is divided into compartments 9 each housing a pole 11 of the circuit breaker 2. The circuit breaker 2 in the example of FIG. 1 is a three-pole circuit breaker, although the invention can also be applied to circuit breakers having any suitable number of poles other than three (e.g., single-pole circuit breakers; multi-pole circuit breakers) (not shown). Accordingly, as used herein, the term "number" shall mean one or more than one (i.e., a plurality). A portion of the housing 4 is cut-away to show internal structures, such as the separable contacts 6, 8 and the operating mechanism 10, which are shown in simplified form for convenience of illustration. Part of the operating mechanism 10 in this example includes an energizing assembly 50 having a handle and ratchet assembly 52 for charging an energy storage device, such as a spring 15 (FIGS. 3A, 4A and 5). The exemplary spring 15 is charged by pumping the handle of the handle and ratchet assembly 52, although other known or suitable charging assemblies, such as for example, without limitation, a motor operator (not shown) could be employed without departing from the scope of the invention. It will also be appreciated that other known or suitable energy storage devices (not shown) other than the spring 15, could be employed. For example, without limitation, it is well known to employ an electrically chargeable solenoid as the energy device of a circuit breaker.

Figure 2:
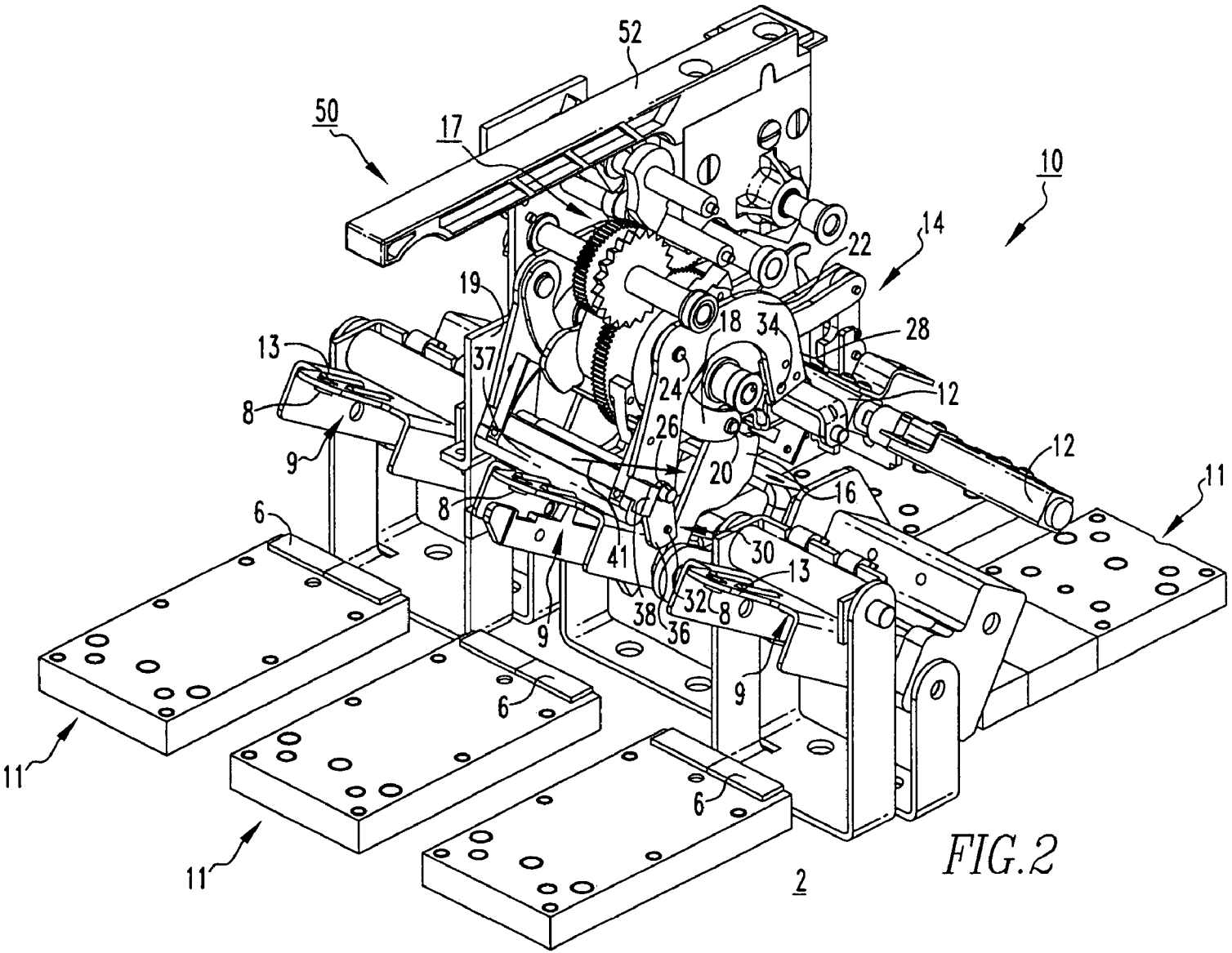
FIG. 2 is an isometric view of the internal components of the operating mechanism for a three-pole circuit breaker, with the circuit breaker housing removed and the separable contacts of the circuit breaker shown in the open position.

Once charged, the spring 15 (FIGS. 3A, 4A and 5) drives either a gear assembly 17, as shown in FIG. 2, or a cam assembly (not shown) (see, e.g., U.S. Pat. No. 6,015,959 FIGS. 1 and 2). The gear assembly 17 rotates the circuit breaker pole shaft or trip bar 12 which, in turn, closes the separable contacts 6, 8. The separable contacts 6, 8 in the example of FIG. 2 are shown in the open position. All of the foregoing is supported by one or more side plates 19 (one side plate 19 is shown in FIGS. 2, 3A, 4A and 5). The energizing portion 50 of the operating assembly 10 and operation of the same, is described in greater detail in incorporated by reference U.S. Pat. No. 6,015,959.

FIG. 2 shows the operating mechanism 10 which includes a trip bar 12 and a cradle assembly 14. The cradle assembly 14 is moveable between the first position shown in FIGS. 2 and 3A, and a second position (FIG. 4A) corresponding to separable contacts 6, 8 being closeable. As employed herein, the term "closeable" refers to positions of the exemplary cradle assembly 14 in which the separable contacts 6, 8 are closed (not shown), and to positions, such as the position shown in FIG. 2, in which the separable contacts are open, but are closeable because the cradle assembly 14 is in its latched position. The latched position shown in FIG. 2 and corresponds to the circuit breaker being OFF. In other words, the separable contacts 6, 8 are readily closeable when the cradle assembly 14 is latched, as shown in FIG. 2, but are not readily closeable when the cradle assembly 14 is unlatched and the separable contacts 6, 8 are tripped open as shown, for example, in FIG. 5. This is because typically under such circumstances, (e.g., in response to a trip condition) the cradle assembly 14 must be reset before the separable contacts 6, 8 can be closed. The exemplary separable contacts 6, 8 comprise stationary contacts 6 and moveable contacts 8 each having a contact arm 9. Three stationary contacts 6 and three corresponding moveable contacts 8 are shown in the three-pole circuit breaker of FIG. 2.

FIGS. 2 and 3A show the exemplary cradle assembly 14 in the aforementioned first position, corresponding to the separable contacts 6, 8 being opened. FIG. 4A shows the cradle assembly 14 in an over-center position corresponding to the separable contacts 6, 8 (FIG. 2) being closed (not shown) and the circuit breaker 2 (FIG. 2) being ON. FIG. 5 shows the cradle assembly 14 in the unlatched position corresponding to the separable contacts 6, 8 being tripped open in response to the trip condition. Operation of the cradle assembly 14 and the exemplary opening assist mechanism 30 therefor, in accordance with the present invention, will now be discussed in greater detail.

As shown, for example in FIG. 3A, the cradle assembly 14 includes a first toggle link 16, a second toggle link 18 pivotally coupled to the first toggle link 16 by a first pivot 20, and a cradle member 22 which is pivotally coupled to the second toggle link 18 by a second pivot 24. The cradle member 22 includes a third pivot 26 about which the entire cradle assembly 14 pivots. The exemplary third pivot 26 comprises a protrusion on the cradle member 22 which is structured to engage a corresponding recess (not shown) in a second side plate (removed for simplicity of illustration) disposed opposite side plate 19. The cradle member 22 has a first end 34 and a second end 36. The first end 34 includes a latching portion 28 which is structured to engage the trip bar 12 (FIGS. 2 and 5) when the cradle assembly 14 is disposed in the aforementioned second position (see, e.g., the closeable position of cradle assembly 14 of FIG. 2 or the closeable position of FIG. 4A in which the separable contacts (not shown) are closed). More specifically, in the example of FIG. 2, the latching portion 28 engages the circuit breaker trip bar 12 when the cradle assembly 14 is latched and the separable contacts 6, 8 are closeable and, as shown in FIG. 5, the latching portion 28 of the cradle member 22 is released when the trip bar 12 pivots in response to the trip condition. This unlatches the cradle member 22 tripping open the separable contacts 6, 8, as shown. In this manner, the operating mechanism 10 and trip bar 12 thereof of the circuit breaker 2 are actuated when the circuit breaker trips.

Figure 3B:
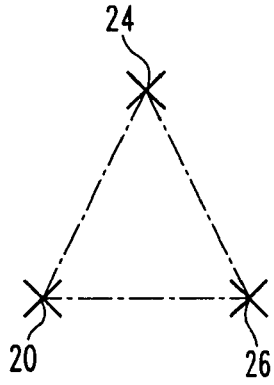
FIG. 3B is a simplified representation of the cradle assembly of FIG. 3A showing the orientation of the pivot points of the cradle assembly when the separable contacts of the circuit breaker are open.
Figure 4B:
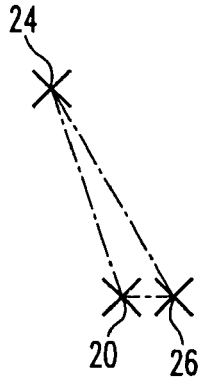
FIG. 4B is a simplified representation of the cradle assembly of FIG. 4A further illustrating the over-center configuration of the pivot points of the cradle assembly.

As best shown in FIG. 3B, when the cradle assembly 14 is disposed in the first position, the first, second, and third pivots 20, 24, 26 are disposed in an orientation generally representative of an isoceles triangle. However, as shown in FIG. 4B, when the cradle assembly 14 is disposed in the second position corresponding to the circuit breaker 2 (FIG. 1) being ON, the first and second toggle links 16, 18 are disposed in the aforementioned over-center configuration. As employed herein, an "over-center configuration" is any configuration in which a plurality of pivotally coupled linkages (e.g., without limitation toggle links 16, 18) have a tendency to become jammed or locked. In the over-center configuration of the example of FIGS. 4A and 4B, the first and third pivots 20, 26 are disposed substantially adjacent to one another, with the overall configuration of the first, second and third pivots 20, 24, 26, being generally representative of an acute triangle (best shown in FIG. 4B). As previously discussed, the first and second toggle links 16, 18 have a tendency to jam in the over-center configuration, which disadvantageously can result in the circuit breaker 2 (FIG. 1) becoming locked in the ON position. In order to resist this tendency, the invention provides the opening assist mechanism 30 for the cradle assembly 14.

As shown in FIGS. 2, 3A, 4A and 5, the opening assist mechanism 30 comprises an actuator 32 disposed on the cradle member 22 which is structured to engage and move at least one of the first and second toggle links 16, 18 in response to an actuation of the circuit breaker operating mechanism 10. Such actuation may comprise, for example, movement of the circuit breaker handle (FIG. 1) by an operator. Additionally, the operating mechanism 10 includes the aforementioned spring 15 (FIGS. 3A, 4A and 5) to bias at least one of the trip bar 12 and the cradle assembly 14. Specifically, as discussed, the spring 15 biases the trip bar 12 towards engaging the latching portion 28 of the cradle assembly 14 in order to latch the cradle assembly 14.

The actuator 32 comprises a toggle link engagement, such as the example kicker pin 32, shown, or any other suitable protrusion on the cradle member 22. The kicker pin 32 in the example shown and described herein is disposed on the cradle member 22 distal from the first end 34 thereof (best shown in FIG. 3A). In particular, the kicker pin 32 protrudes from the cradle member 22 proximate the third pivot 26 thereof, and is structured to engage and deflect the first toggle link 16 in the direction generally indicated by the arrow 39 of FIG. 4A. This, in turn, results in the first toggle link 16 pivoting counter-clockwise (with respect to FIG. 4A) about the first pivot 20, and moving the second toggle link 18 which is pivotally coupled thereto. In this manner, the cradle assembly opening assist mechanism 30 functions to displace the cradle assembly 14 from the over-center configuration and, therefore, resists the first and second toggle links 16, 18 from becoming undesirably jammed or locked in such configuration.

In summary, it will be appreciated that, in operation, the operating mechanism 10 of the circuit breaker 2 (FIG. 5) is operable among the ON position (FIG. 4A) in which the separable contacts 6, 8 (FIG. 5) are closed (not shown), and OFF (FIG. 3A) and tripped (FIG. 5) positions wherein the separable contacts 6, 8 (FIG. 5) are open. As shown in FIG. 4A, and the corresponding diagram of FIG. 4B, the first and second toggle links 16, 18, as previously discussed, are disposed in the over-center position when the circuit breaker 2 (FIG. 5) is ON and, when the operating mechanism 10 of the circuit breaker 2 (FIG. 5) is moved from the ON position, the actuator (e.g., kicker pin 32) engages the first toggle link 16 and removes the first and second toggle links 16, 18 and, thus, the cradle assembly 14, from the over-center configuration, as previously discussed.

It will also be appreciated that additional mechanisms for facilitating the removal of the cradle assembly 14 from the over-center configuration could be employed in addition to the example kicker pin actuator 32. For example, without limitation, as previously discussed, the trip bar 12 of the circuit breaker 2 is structured to pivot in response to a trip condition, thereby releasing the latching portion 28 of the cradle member 22. This, in turn, releases the cradle assembly 14, unlatching it and causing the actuator 32 of the cradle member 22 to engage the first toggle link 16 in order to move the cradle assembly 14 out of the over-center configuration. A bias element, such as the pusher tab 38, shown in FIG. 2, could be employed to further facilitate the initiation of the foregoing sequence of events. Specifically, as best shown in FIG. 2, the circuit breaker 2 has a stop 37 for limiting movement (upward movement from the perspective of FIG. 2) of the contact arms 13. The pusher tab 38 is a relatively flat member which is coupled to the stop 37 for the center moveable contact arm 13. The pusher tab 38 is generally structured to engage and bias the second end 36 of the cradle member 32 in the direction (to the right from the perspective of FIG. 2) generally indicated by the arrow 41 of FIG. 2. In this manner, the pusher tab bias element 38 of the opening assist mechanism 30 biases and, thus, initiates movement of the cradle member 22 of the cradle assembly 14 in order that the actuator (e.g., kicker pin 32) moves the first toggle link 16 and thereby further resists the jamming of the toggle links 16, 18 in the over-center configuration. It will be appreciated that the bias element (e.g., flat pusher tab 38) is an optional element not required by the opening assist mechanism 30 of the invention. The kicker pin 32 operates to independently resist locking of the cradle assembly 14 in the over-center configuration.

Accordingly, the present invention provides a cradle opening assist mechanism structured to prevent an electrical switching apparatus, such as a circuit breaker, from becoming undesirably locked in the ON position or any other position in which a plurality of linkages (e.g., without limitation, first and second toggle links 16, 18, and cradle member 22) become jammed in an over-center configuration.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical switching apparatus comprising:

a housing;

separable contacts enclosed within said housing; and an operating mechanism for opening and closing said separable contacts, said operating mechanism including a trip bar and a cradle assembly, said cradle assembly being moveable between a first position corresponding to said separable contacts being open, and a second position corresponding to said separable contacts being closeable, said cradle assembly comprising:

a first toggle link, a second toggle link pivotally coupled to said first toggle link by a first pivot, a cradle member pivotally coupled to said second toggle link by a second pivot, said cradle member including a third pivot and a latching portion structured to engage said trip bar when said cradle assembly is disposed in said second position, and an opening assist mechanism comprising an actuator disposed on said cradle member and structured to engage and move at least one of said first and second toggle links in response to an actuation of said operating mechanism, wherein said first and second toggle links have a tendency to jam in an over-center configuration, wherein said opening assist mechanism resists said tendency; and wherein said separable contacts comprise a stationary contact and a moveable contact having a contact arm and a stop therefor; wherein said cradle opening assist mechanism includes a bias element coupled to said stop; and wherein said bias element is structured to bias and initiate movement of said cradle member of said cradle assembly in order that said actuator moves said at least one of said first and second toggle links, thereby further resisting the jamming of said toggle links in said over-center configuration.

* * * * *